US006115975A

United States Patent [19]

Abdollahi

[11] Patent Number: 6,115,975

[45] Date of Patent: Sep. 12, 2000

[54] STAIR SYSTEM

[76] Inventor: Hassan Abdollahi, 13428 Benson Ave., Chino, Calif. 91710

[21] Appl. No.: 09/063,538

[22] Filed: Apr. 20, 1998

[51] Int. Cl.[7] ..... F04F 11/16

[52] U.S. Cl. ..... 52/179; 52/288.1; 52/718.04; 52/741.2

[58] Field of Search ..... 52/179, 182, 188, 52/741.2, 288.1, 718.04, 716.04, 718.01

[56] References Cited

U.S. PATENT DOCUMENTS

| | | | |
|---|---|---|---|
| 603,130 | 4/1898 | De Man | 52/182 |
| 2,696,027 | 12/1954 | Ryland | 52/182 |
| 3,909,997 | 10/1975 | Eickhof | 52/188 |
| 4,321,294 | 3/1982 | Naka | 52/179 X |
| 4,455,797 | 6/1984 | Naka | 52/179 |
| 5,073,430 | 12/1991 | Aidan | 52/179 X |
| 5,706,623 | 1/1998 | Brown | 52/179 X |
| 5,806,253 | 9/1998 | Nelson | 52/179 |

FOREIGN PATENT DOCUMENTS

| | | | |
|---|---|---|---|
| 2671822 | 7/1992 | France | 52/188 |

*Primary Examiner*—Carl D. Friedman
*Assistant Examiner*—Timothy B. Kang
*Attorney, Agent, or Firm*—William G. Lane

[57] ABSTRACT

A stair system employing an improved stair nose molding and back molding which provides for a stair system having a free-floating riser and a free-floating tread, the stair nose molding having a cutout with tongue for receiving grooved stair tread and a groove for receiving a riser in a sliding arrangement. The stair back molding having a groove to receive the bottom edge of the riser in a sliding arrangement. The tread is secured to the stair nose molding, the riser being slidably secured in the stair nose molding and the stair back molding, and the end of the tread being secured along with the back stair molding to the tread subflooring.

13 Claims, 4 Drawing Sheets

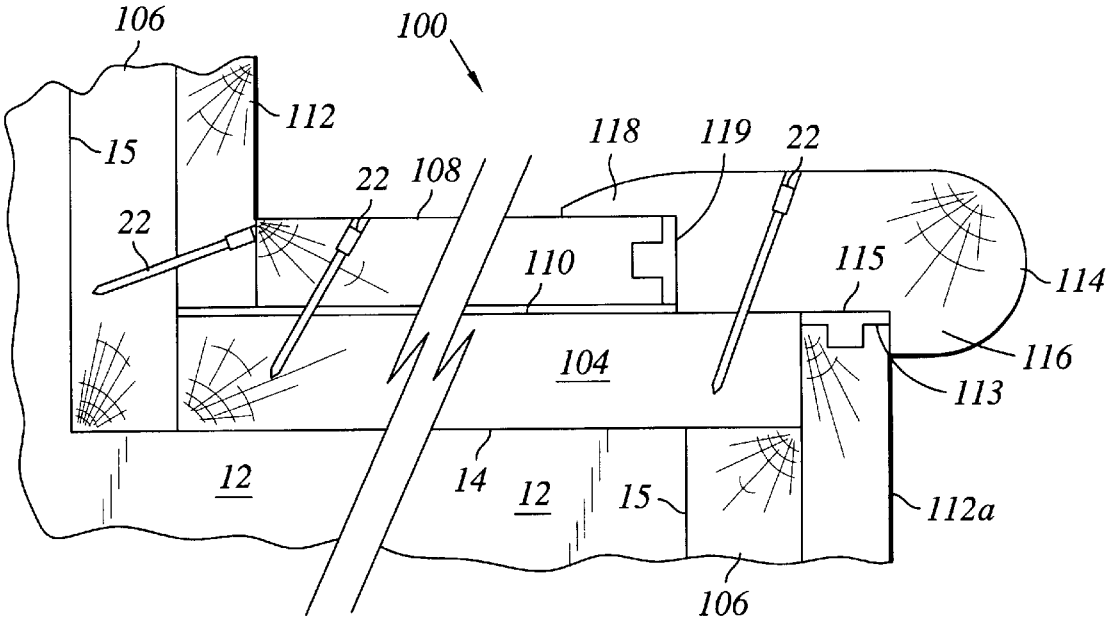
(PRIOR ART) Fig. 1
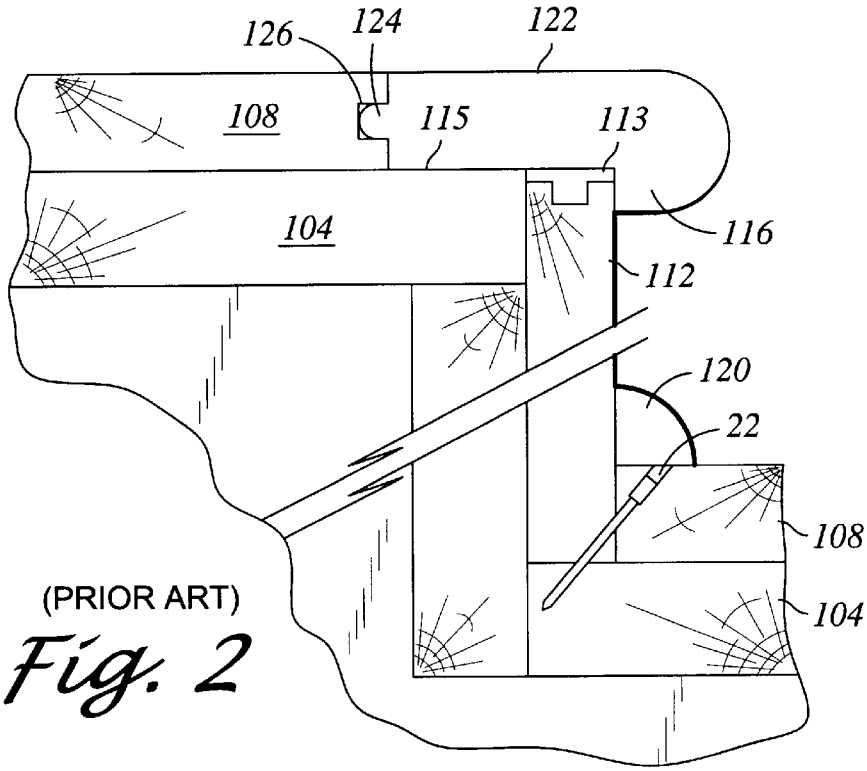
(PRIOR ART)
Fig. 2

STAIR SYSTEM

FIELD OF THE INVENTION

The present invention is directed to stair systems and stair nose molding and stair back molding for stair cases.

BACKGROUND OF THE INVENTION

For several hundred years, stair systems employing nose molding have been constructed in a similar manner by the same basic method.

Referring to FIGS. 1 and 2, a stair system is supported by stringers 12, having tread sides 14 cut out, on which are secured tread subflooring 104 and tread 108 and riser sides 15 cut out, on which are secured riser subflooring 106 and risers 112. The riser subflooring 106 is secured to the riser side 15 of the stringers and the tread subflooring 104 is secured to the tread side 14 of the stringer. Subflooring is normally secured by nailing, screwing, and/or with the use of adhesives. Stairs are normally built from the top down. The hardwood floor at the top of the stairs is built to within about one to two inches of the edge of the stair top. The end of the hardwood flooring which is on top of the subflooring on top of the stairs is mated with and covered with the conventional stair nose 114 which has a bottom lip 116 and a top lip 118. The top lip 118 covers and engages the end of the hardwood flooring. The stair nose is secured to the subflooring either with glue and/or nails 22. Glue is used because it eliminates face nailing, i.e., the step of countersinking the nail and filling in the countersink area. However, the gluing must be done well because the stair nose, which is relatively large, takes great stresses as a person steps on the stair nose when descending or ascending the stairs. Because of the tendency of natural wood to expand and contract with changes in humidity and temperature, the large wood stair nose and natural wood tread and riser are constantly working and eventually can loosen the adhesive bond between the stair nose and subflooring. The stair nose is secured to the subflooring at the top of the stairs so that there is sufficient room between the edge of the subflooring 104 and the first subflooring riser 106 and the lip 116 to receive the top edge finished riser 112. A space of ¼ inch to ⅛ inch is left between the edge of the flooring at the top of the stairs and the back end 119 of the stair molding to provide expansion space for the floor. A space of 3⁄16 to 1⁄16 inch is left between the top edge 113 of the riser and the bottom side 115 of the stair nose molding to provide expansion space for the riser.

The first step below the top of the stairs is constructed by sizing and cutting the finished riser 112, and inserting the top edge of the riser into the space between the front edge of the subflooring at the top of the stair and the lip 116. The riser must be cut within a ⅛ inch to provide expansion space 113. The bottom of the riser rests on foam pad 110. The riser is preferably nailed into the subflooring 106 with a nail 22, as shown in FIG. 1, or glued to the subflooring. The nail 22 nail can be hidden by the finished tread 108 in which case it does not have to be countersunk. The finished tread 108 for the first step is cut to size and laid down over the tread subflooring 104 with a foam padding 110 disposed between the finished tread subflooring. The foam pad is optional. The finished tread must be cut neatly and square at its back edge. The rear of the tread 108 is secured to the subflooring by nail 22. If desired, the nail hole can be covered with molding (not shown). However, the molding must be face nailed requiring counter sinking the nail and filling the counter sunk hole. The front of the tread 108 is held down by the underside of lip 118 of the stair nose. A small amount of space from ⅛ to ¼ inch is left between the back side 119 of the stair nose 114 and the front side of the tread 108 to allow for expansion of the tread 108. Most treads, as well as stair nose, molding and risers, are made of wood, especially hardwood. This wood is normally kiln-dried. Depending upon the humidity of the environment, the wood can absorb or lose moisture, thus expanding or contracting the wood. Stair nose molding 114 can be secured in the subflooring by nail 22 and/or adhesive applied to the underside 115 of the stair nose, nailing is preferred because of the stresses placed on the stair nose when a person steps on it. The point A is a fulcrum about which the stair nose attempts to pivot when a person steps on the front half of the stair nose. This places great force on the back half of the stair nose, tending to force it to pivot upward as the front half tends to be forced downward.

For the next stair, the operation is repeated. The finished riser 112A is cut to size, the top of the riser is inserted into the groove between lip 116 and the front edge of the subflooring 104. The bottom of the riser 112A rests on the subflooring 104 with foam pad 110 disposed between the bottom edge and the subflooring. The riser is secured to the subflooring. The finished tread 108 is cut and sized and positioned onto the subflooring 104 of the second step with the foam pad 110 disposed between. The back edge of the finished tread must be cut precisely to obtain a neat joint with the riser. The stair nose molding is then secured to the front of the stairs with the lip 116 engaging the top of the finished tread 108. Sufficient space is left between the lip 116 of the stair nose molding and the stair subflooring to allow for the next riser to be inserted in the space between the lip and the subflooring as described above.

Natural wood staircases are very attractive but environmentally destructive because of the amount of clear grain wood they require. Even veneer plywood treads and risers require a clear grain veneer wear surface. The large conventional hardwood stair noses require substantial amounts of kiln-dried clear grain hardwood.

FIG. 2 shows an alternative embodiment of the prior art stair system. The stair system is very similar to the stair system shown in FIG. 1, except that the finished tread is applied directly to the subflooring 104, i.e., it has no foam pad disposed between the tread and the subflooring. The stair nose 122 does not have an upper lip 118. The back of the stair nose has a tongue 124 for a tongue and groove system. The edge of the tread, and the hardwood flooring at the top step also, have a groove 126 adapted to receive the tongue 124. This type of stair nose is normally not used with free-floating treads as in FIG. 1. Tread 108 is secured to the subflooring with nails and/or adhesive. Stair nose 122 can be secured to the subflooring either with adhesive applied to the lower surface 115 or with nails. Nailing is preferred because of the great stresses placed on the relatively long stair nose as for the same reasons described above with respect to the stair nose of FIG. 1. The union between the stair nose and the front edge of the tread 108 requires careful shaping and sawing so that the back side of the stair nose mates evenly with the front side of the tread 108. If back stair molding 120 is not used, the back edge of the tread requires careful shaping and cutting so that the joint with the riser is neat and decoratively pleasing. In all other respects, this stair system is identical to the stair system shown in FIG. 1.

Although the above stair systems have been used for many, many years, they are not perfect. The system of FIG. 1 permits the tread and riser to be free-floating, thus allowing them to contract and expand with changing temperature and humidity conditions in the environment. However, the lip 118 is not an attractive feature and it has some safety problems since it requires a person descending the floor to raise his or her heel to clear the lip when descending the stairs. A heel can tangled up with lip 118 and cause a person to fall. In addition, the constant hitting of the lip 118 with heels of shoes causes uneven wear to the lip.

The stair system of FIG. 2 is more attractive and does not have the disadvantages of the lip design of the stair molding 114. However, this system does not permit the tread to be free-floating. The tread must be secured to the subflooring 104, either with glue and/or with nails. The securing of the tread to the subflooring does not stop the tread from expanding and contracting with environmental changes. This loosens the tread from the subflooring with usage and time.

The finished carpentry industry for years has been looking for a system that would permit the use of free-floating tread that would compensate for contraction and expansion of the tread with changing temperature and humidity conditions, and yet allow the top of the stair nose and the tread to be coplanar, i.e., even, to give a more attractive finish, to give better wear qualities, and to avoid any potential hazard with the hang-up of the lip, such as shown in FIG. 1.

The finished carpentry industry has been looking for a composite tread and rider stair that does not expand and contract like wood plank stair systems and would minimize the use of clear grain hardwoods.

It is one object of the present invention to provide a stair system with a free-floating tread that does not require glue or adhesive between the tread and subflooring.

It is the object of the present invention to provide a stair system wherein the stair nose, tread and riser may be secured to the stair subflooring with adhesives alone.

It is another object of the present invention to provide a decorative wooden staircase with the minimum use of expensive axle wood, especially large decoratively pleasing wooden planks for the tread, riser and/or stair nose.

It is still a further object of the present invention to provide a stair system that has a small stair nose in order to minimize the forces exerted on the stair nose when a person steps on the stair nose when ascending or descending the stairs.

It is still a further object of the present invention to provide a stair nose system where the bulk of the wear on the stair will be taken by the tread rather than by the stair nose.

It is an object of the present invention to provide a stair system which utilizes the stringers and subflooring of the existing stair systems.

It is another object of the present invention to provide an improved stair system which permits the stairs to be built without precision cutting.

It is a further object of the present invention to provide a stair system where the riser is free-floating and not secured to the stair subfloor.

It is another object of the present invention to provide an improved stair system which permits the center portion of the tread to be free-floating.

It is a further object of the present invention to provide an improved stair nose which permits the stair system to be built with a tread having its center portion free-floating and having the top of the stair nose and the tread in the same plane.

It is still another object of the present invention to provide a simplified system of securing the back of the tread to the subflooring and to hide it with an attractive molding.

It is still another object of the present invention to provide a method of installing a finished tread and riser with rough cutting and a minimum of accurate cutting so that the stair system can be quickly installed.

An even further object of the present invention is to provide a stair system wherein the back edge of the tread does not have to be neatly or accurately cut to size to yield an attractive and secure stair system.

SUMMARY OF THE INVENTION

The present invention is directed to an improved stair nose molding having perpendicular planar back side and top side to position the stair nose molding to a stair subflooring, a front side, and a bottom side, a planar cutout in the top side extending to the back side with a vertical front wall and a horizontal bottom wall to receive tread/flooring with the top side of the tread/flooring coplanar with the stair nose molding top side, a tongue extending outwardly from the vertical front wall and adapted to engage a corresponding groove in the side of the tread/flooring to secure the stair nose molding and tread/flooring together, and a groove with parallel walls extending upwardly into the stair nose molding from the bottom side to receive a top edge portion of a stair riser.

The present invention is also directed to an improved stair back molding having perpendicular planar back side and bottom side to position the molding back side against a stair riser subfloor and a bottom side against a stair tread, a front side, and a top side, and a groove with parallel walls extending downwardly into the stair back molding from the top side to receive the bottom edge portion of a stair riser.

The front side of the stair nose molding and/or stair back molding can be shaped for decorative purposes.

The present invention is also directed to a stair system comprising a plurality of parallel stair stringers cut out for one or more steps, each step of the stringers bridged by a tread subflooring and a riser subflooring; the stair system comprised of one or more steps, each step comprising:

a tread/flooring positioned on the stair tread/flooring subfloor and having a groove in its front edge to receive a corresponding tongue of a stair nose molding;

a riser with a top nose portion and a bottom edge portion;

a stair nose molding secured to the top of a step having a perpendicular planar back side and top side to position the stair nose molding to the stair subflooring, a front side, and a bottom side, a cutout in the top side extending to the back side with a vertical front wall and horizontal bottom wall to receive the tread/flooring with the top side of the tread/flooring coplanar with the top side of the stair nose molding, a tongue extending outwardly from the vertical front wall and received and secured in the groove in the front side of the tread flooring, and a groove with parallel walls extending upwardly into the stair nose molding from the bottom side and receiving in a sliding relationship the top edge portion of the riser; and a stair back molding having a perpendicular, planar back side and bottom side to position the molding back side against the stair subfloor and the bottom side against the stair tread/flooring below the step, and a groove with parallel walls extending downwardly into the stair back molding from the top side receiving the bottom edge portion of the stair riser.

The back side of the stair nose molding is preferably secured to the riser subflooring with an adhesive thereon, the stair nose molding can be secured to the stair subflooring with one or more screws and/or nails. The stair back molding and the rear edge of the tread/flooring can be secured to the stair subflooring by one or more nails an/or screws extending from the bottom of the channel in the stair back molding, through the stair back molding, and through the back edge portion of the tread/flooring into the subflooring.

The present invention is also directed to a method of finishing a stair system comprising a plurality of parallel stair stringers bridged by stair subflooring comprised of tread subflooring and riser subflooring, the method comprising:

cutting and securing a stair back molding to the stair subflooring and the terminal flooring of the stair system, the stair back molding having perpendicular planar back side and bottom side to position the molding back side against the stair riser subflooring and the bottom side against the terminal flooring, and a groove with parallel walls extending downwardly into the stair back molding from the top side to receive the bottom edge position of a stair riser;

cutting a stair riser, having a top edge and bottom edge, to the height of the stairs so that the distance between the top edge and the bottom edge permits the stair riser to be inserted in channels in stair back molding and in the stair nose molding so that the stair riser can expand and contract;

positioning the bottom edge of a stair riser in the channel in the stair back molding;

cutting and joining stair nose molding and tread to fit on the first step of the stair system, the width of the tread being cut so that the back edge of the tread is spaced apart from the stair riser subflooring for tread expansion, the stair nose molding having perpendicular planar back side and top side to position the back side of the stair nose molding against the stair subflooring, a front side and a bottom side, a planar cutout in the top side extending to the back side with a vertical front wall and horizontal bottom wall to receive tread with the top side of the tread coplanar with the top side of the stair nose molding, a tongue extending outwardly from the vertical front wall and being received within and secured within the groove in the front side of the tread, the stair nose molding having a groove with parallel walls extending upwardly into the stair nose molding from the bottom side to receive the top edge of the stair riser, the combination of the stair nose molding and tread being positioned on the first step with the top edge portion of the stair riser being received within the groove of the stair nose molding, the back side of the stair nose molding being secured to the stair subflooring, the tread being secured to the stair subflooring at its back edge.

The tread of the first step can be secured together with the stair back molding for the second step by positioning the bottom side of the stair back molding against the back edge of the tread and the back side of the stair back molding against the stair subflooring by driving nails from the bottom of the channel in the stair back molding through the stair back molding, and through the back edge of the tread into the stair subflooring.

The tread of the first step can be secured together with the stair back molding for the second step by positioning the bottom side of the stair back molding against the back edge of the tread and the back side of the stair back molding against the stair subflooring by screwing screws from the bottom of the channel in the stair back molding through the stair back molding, and through the back edge of the tread into the stair subflooring.

The top step can be constructed by securing the stair back molding of the top step to the back edge of the penultimate step and the stair subflooring by driving nails through the channel of the stair back molding through the stair back molding and through the back edge of the tread flooring into the stair subflooring; and positioning the bottom edge of the stair riser into the channel of the stair back molding; positioning the stair riser into the channel of the stair nose molding and securing the flooring at the top of the stairs into the cutout of the stair nose molding so that the tongue of the stair nose molding is received by and secured in the groove in the flooring at the top of the stairs, and the back side of the stair nose molding is secured to the stair subflooring.

BRIEF DESCRIPTION OF THE DRAWINGS

FIG. 1 shows a fragmentary cross-sectional view of an existing stair system;

FIG. 2 is a fragmentary cross-sectional view of another existing stair system;

DETAILED DESCRIPTION OF THE INVENTION

Figure 3:
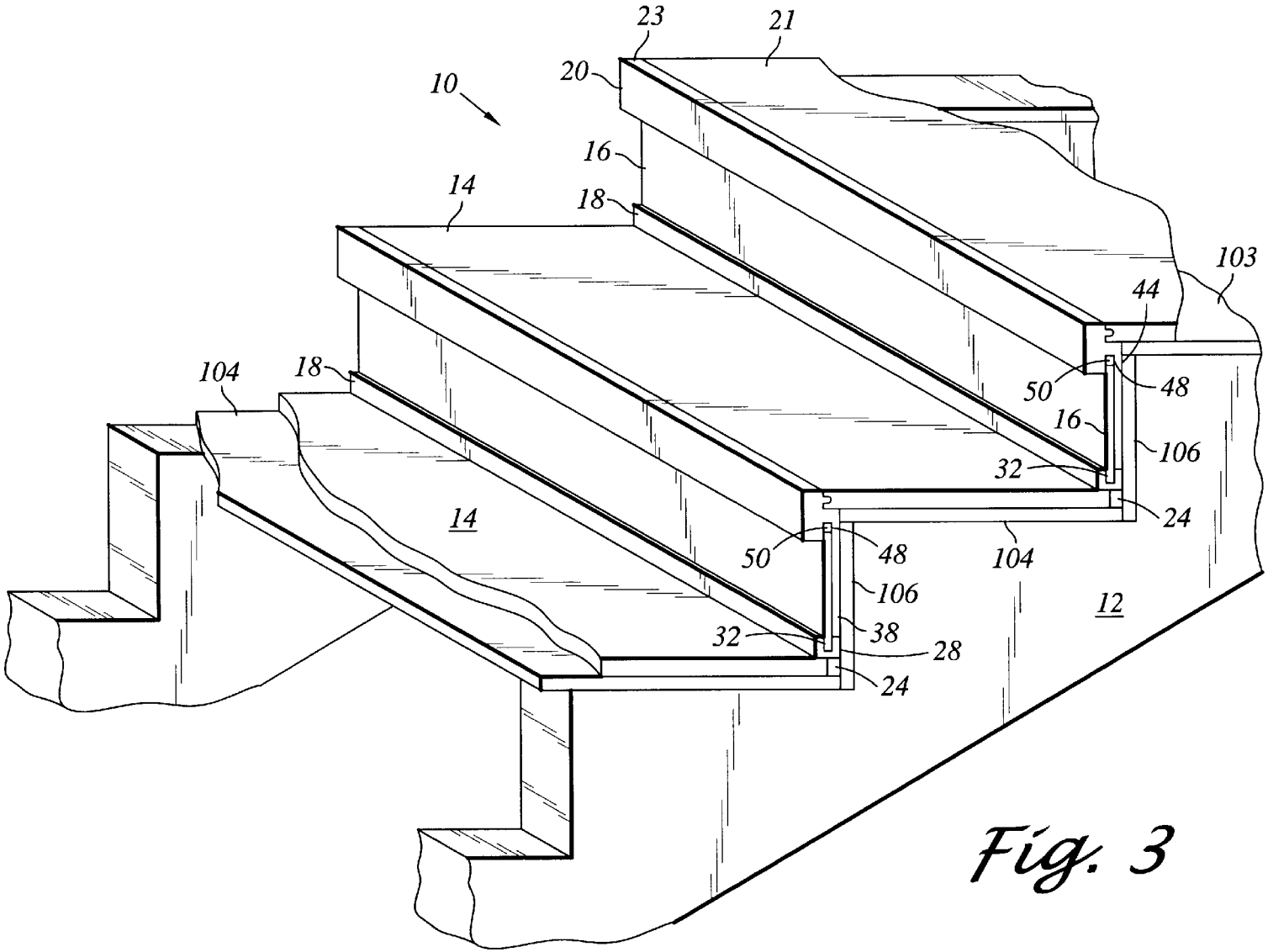
FIG. 3 is a top front perspective view of the stair system of the present invention.
Figure 4:
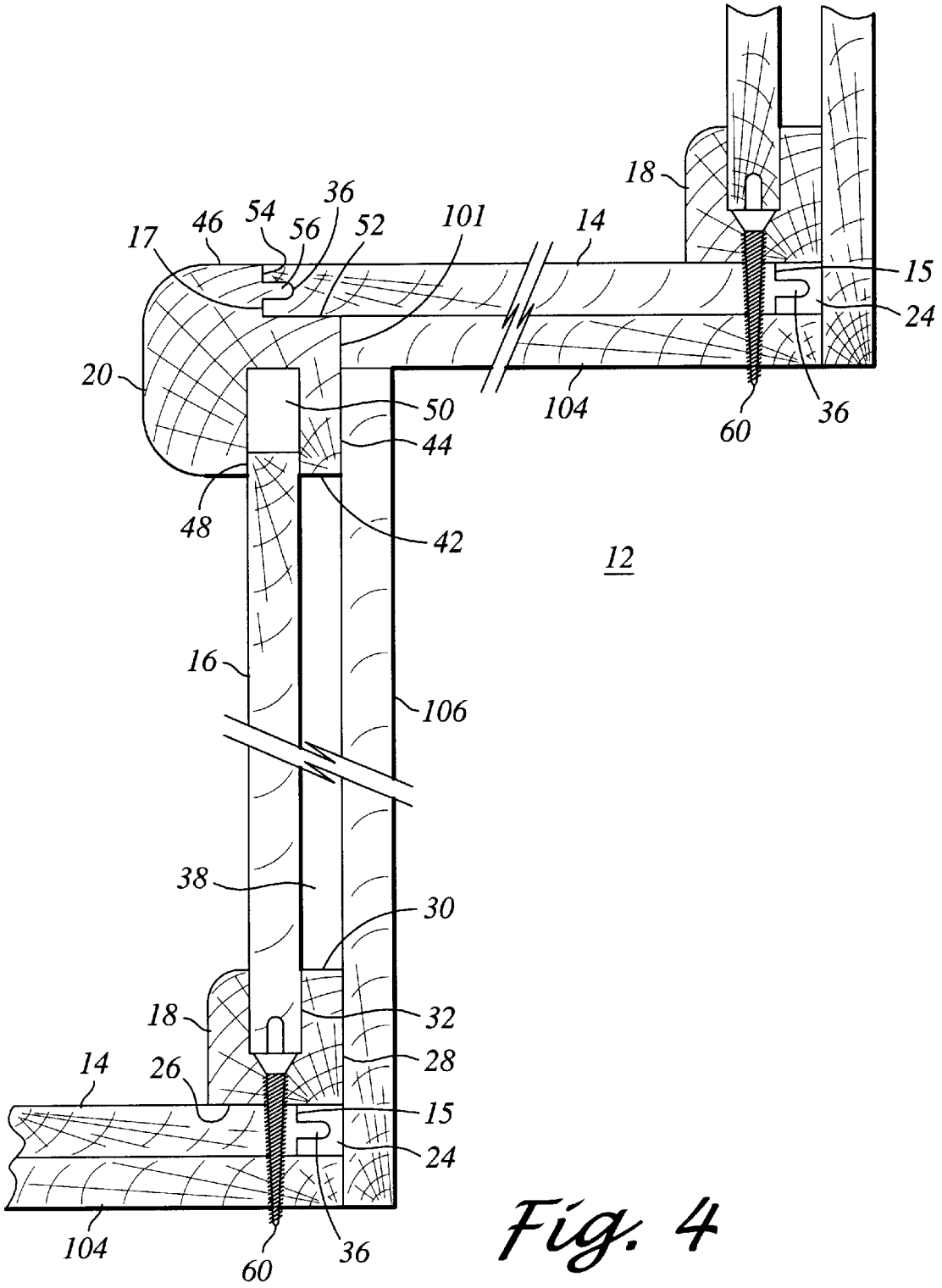
FIG. 4 is a fragmentary cross-sectional view of the stair system of the present invention.
Figure 5A:
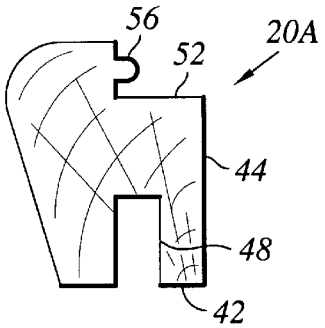
FIG. 5A through FIG. 5F show cross-sectional views of alternative embodiments of the stair nosing of the present invention.
Figure 5B:
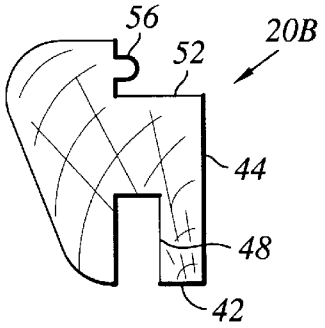
Figure 5C:
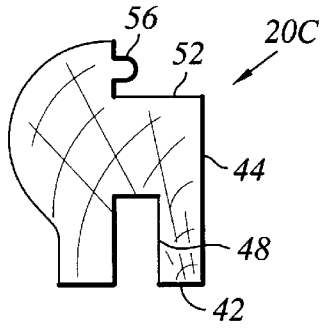
Figure 5D:
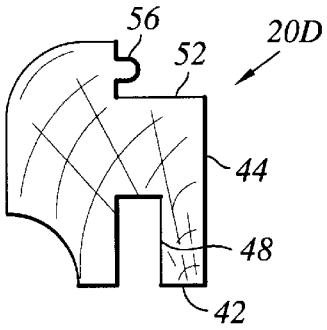
Figure 5E:
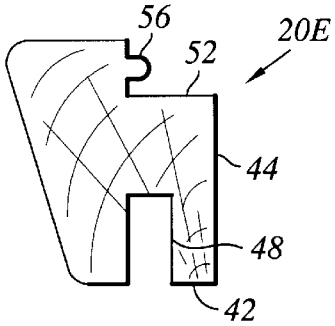
Figure 5F:
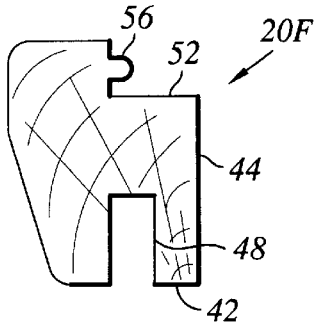

Referring to FIG. 3, the staircase of the present invention has the normal stair strings 12, one positioned on each side of the stair. Frequently, additional stringers are positioned between the two end stringers to give additional support and strength, depending upon the width of the stairs and the anticipated traffic on the stairs. Most stairs today are constructed with floor subflooring 103 at the top of the stairs and with floor subflooring (not shown) at the bottom of the stairs. However, when the stairs land or terminate on a concrete pad or the like, normally there will be no subflooring at the bottom of the stairs. Each of the tread areas and the riser areas are constructed with subfloorings 104 and 106 respectively. The subflooring strengthens the stair system and gives it more rigidity. In addition, it makes the stairs sound solid and normally makes the stairs quieter. However, there are instances where the subflooring is omitted and the riser and the tread function both as a subflooring and as the finished stair riser and tread.

Traditionally, only natural plank wood, such as oak plank, was used as riser and tread on such stair systems. However, new composite treads and risers have entered the market which are virtually unaffected by changes in temperature and humidity.

With the present system, this finished construction of the stairs can start either at the top or the bottom, or for that matter, in the middle. However, it is normally easier to start from the bottom step and work up the staircase, but it is possible for one finish carpenter to work at the top of the stairs and for another finish carpenter to work at the bottom of the stairs with the first finish carpenter working downward and the bottom finishing carpenter working upward to complete the stairs. This is not the case in standard stair systems for reasons that will be explained herein.

The hardwood or veneer flooring 21 at the top of the stairs has its front edge 23 cut squarely and precisely to form a cosmetic union with the stair nose 20. The forward edge 23 of the flooring 21 extends a predetermined distance beyond the front edge 101 of the subflooring 104 so that the back side 44 of the stair nose 20 can mate evenly with the forward edge of the subflooring 102 and the front surface of the riser subflooring 106. The stair nose is secured to the subflooring (104 and 106) by conventional means, such as nailing, screwing, or gluing. Gluing is preferred and the back side 44 of the stair nose has sufficient area to ensure a good adhesive bond between the back side of the stair nose and the subflooring.

The stair riser 16 has its top edge riding in groove 48 of the stair molding 20. The bottom edge of the stair riser 16 rests in groove 32 of the back molding 18. Stair risers are normally 7½ inches±½ inch high. However, there are situations where the rise of the stairs is less than 7 inches or greater than 8 inches. In that situation, the riser, which is normally tongued on one edge and grooved on the opposing edge, will have to have one edge cut to size the stair riser to the desired height. Since the stair riser does not join with anything by tongue and groove in the present stair system, it does not matter that the tongue edge and/or the groove edge are cut off. Normally, the riser will be cut from tread composite floor panels.

The width of the grooves 48 and 32 is slightly larger than the thickness of the riser 16 so that the grooves closely receive the riser. The riser is not loose and does not rattle within the grooves. However, the grooves are sufficiently wide to permit the riser to slide within the grooves so that the riser can be installed in the grooves relatively easily. The riser 16 is spaced apart from the riser subflooring 106 to give space 38 which acts as a sound absorbing space and as an insulation space.

The stair tread 14 is cut to size so that its front edge will be square to the stair nose 20 and its back edge will be spaced apart from the riser subflooring 106. Since the back edge will be hidden under the back molding, the back edge does not have to be cut neatly or with precision. Most manufactured stair treads have the back end portion 15 of the tread 14 secured to the tread subflooring 104 by conventional means, such as nails, screws 60, and/or adhesive or glues. Preferably, the back edge of the tread is secured to the subflooring by screws which are screwed through the bottom of groove 32 of the back molding 18. After the back molding has been installed, the riser 16 is inserted into the groove 32 and the stair nose 20 with the tread 14 of the next step up attached thereto is installed with the top edge of the stair riser 16 inserted into groove 48 of the stair molding. As stated above, the stair nose can be secured to the riser subflooring 106 in the front edge of the tread subfloor 104 with adhesive and/or by nailing it or by screwing it into the subflooring. The front edge 17 of the tread 14 is attached by placing the front of the tread into the cutout 52 of the stair nose molding, and having the tongue 56 of the stair nose molding received in the groove 36 of the tread. Preferably, the stair nose molding and tread are glued together. The height of the stair riser 16 is cut or dimensioned so that the riser does not extend into the full depth of the groove 48 of the stair nose. The space between the top edge of the riser and the end of the groove is expansion space for the riser.

Preferably, the stair treads and stair risers are made from laminate flooring or composite flooring such as Duramar brand flooring. The laminate flooring has a base core made of high density fiber board such as 45 lb. or 60 lb. high density fiber board. Normally, the thickness of the core material is ¼ inch to 5/16 inch. A wood grain pattern, normally a printed wood grain pattern on a polymer impregnated paper backing, is secured to the core material with an adhesive, such as thermosetting or thermofusing adhesive under great pressure and of an elevated temperature. The wood grain pattern design is protected by a surface overlay protective material, such as an aluminum oxide layer having a weight of about 45 grams per square meter. The bottom of the core material is covered with a melamine backer film having a weight of about 45 grams per square meter. The aluminum oxide surface overlay and the melamine backer are thermo-fused to the paper wood grain pattern sheet and to the back of the core under great pressure at an elevated temperature. This tread and riser material is very stable and there are little movement and expansion from changes in humidity and/or temperature. In addition, the treads and risers are perfectly flat and do not warp or bow when wetted or dried. In fact, the material can be immersed in water for 24 hours and absorb only a small amount of water. This was determined by immersing a composite board in a bucket of water for a 24-hour period, a 5% swelling in thickness to the treads and risers were noted.

The stair nose with the attached tread 14 is positioned on the subflooring 104 with the back side 44 of the stair nose positioned against the riser subflooring 106 and the front edge 101 of the tread subflooring 104. The stair nose is secured to the subflooring, preferably with an adhesive. The back end 15 of the tread is secured by the screw or nail (not shown) through the groove 32 of the bottom molding 18 through the back end portion 15 of the tread 14 into the subflooring 104. The mid-portion of the tread between the front end 17 and the back end 15 of the tread are free-floating.

If it is desired to proceed from the top step down towards the bottom step, tread 14 with the attached stair nose 20 is first placed down, the top edge of the stair riser is inserted into the groove 48 of the stair nose, and the bottom end or edge of the riser inserted into the groove 32 of a back molding 18 and the back molding is positioned in place. The next combination of stair nose 20 and tread 14 is inserted similarly into the next step downward. The stair riser 16 and back molding 18 are moved upward so that the top edge of the riser extends fully into the groove 48, giving space for the back edge 15 of the tread 14 of the next step to be inserted between the tread subflooring 104 and the bottom side 26 of the back molding 18. After the tread is in position, the back molding is positioned on top of the back portion of tread 14 and against the riser subflooring 106. The back molding is secured to the riser subflooring 106 by gluing the back side 28 of the back molding against the riser subflooring 106 and/or nailing or drilling through the back molding, either horizontally into the riser subflooring 106 or preferably downward through the groove 32 of the back molding through the back end of the tread 14 into the subflooring 104. After the stair back molding and the tread is secured, the riser 16 is cut to size and the top edge of the riser is inserted into groove 48 of the stair nose molding 20 of the step above. The top of the riser is extended fully into the groove 48 so that the bottom edge of the riser can clear the top of the stair back molding 18. The bottom edge of the riser is then allowed to drop into groove 13 of the back stair molding. The groove 48 in the stair nose molding is deeper than the groove 32 in the stair back molding to permit this operation. If desired, but not necessary, a small amount of adhesive can be placed on the top edge of the stair riser and the bottom edge of the stair riser to secure the stair riser into the grooves 48 and 32.

The present stair system permits the back edge 15 of the tread 14 to be hidden under the back molding 18. It also permits the top edge and bottom edge of the riser to be hidden in groove 48 and groove 32.

This system simplifies the construction of stairs. The top edge and bottom edge of the riser only have to be cut to a general dimension within 3/16 of an inch. The cut can be rough since the top and bottom edges are hidden in the stair nose molding 20 and stair back molding 18. The edges do not have to be squared off edges since they are hidden in the groove 48 and the groove 32 of the stair nose 20 and back molding 18, respectively. Similarly, the width of the tread 14 only has to be cut to a general dimension within ¼ inch. In addition, the back edge of the tread does not have to be cut with precision or in a squared off manner since the back edge is hidden underneath the back molding 18. Only the front edge 17 of the tread, the edge having the groove 36 of the tread, has to be neat, sharp and squared. This is not a problem since normally the front edge 17 and groove 36 are prepared in the manufacturing step of the composite or laminate tread, and thus the front edge of the tread is sharp, precise and squared when purchased which provides a neat and decorative union with the stair nose.

Referring to FIGS. 5 and 6, the stair molding and the back molding can be manufactured in a variety of cross-sectional shapes to give the architect and the carpenter a variety of shapes and decorative designs to use on the staircases. The molding is not limited to these shapes, and these shapes are only presented for purposes of illustration. Other creative shapes will and can be created. The stair nose shown in FIGS. 5A through 5F have bottom sides 42, back sides 44, a groove 48 extending upward from the bottom side, a lip 52 at the top, and a tongue 56 in the vertical wall of the lip.

Figure 6A:
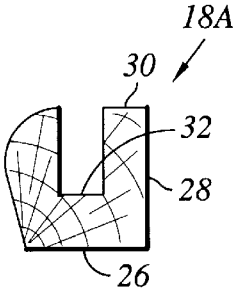
FIG. 6A through FIG. 6C show alternative embodiments of the back stair molding of the present invention.
Figure 6B:
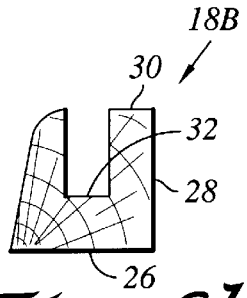
Figure 6C:
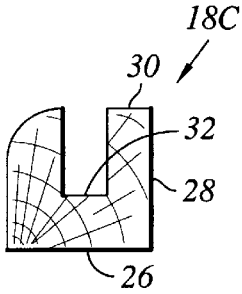

The back molding illustrated in FIGS. 6A through 6C have a bottom side 26, which will be mounted on the top side of the tread 14 at the back edge of the tread, a back side 28 which will be mounted against the bottom end of the riser subflooring 106, a top side 30, and a groove 32 extending downwardly from the top side 30.

Although the invention has been illustrated with specific embodiments, it is the intent of the applicant that other embodiments of the invention which fall together in the spirit of the invention are also included herein.

What is claimed is:

1. A stair system comprising a plurality of parallel stair stringers cut out for one or more steps, each step of the stringers bridged by a tread subflooring and a riser subflooring; the stair system comprised of one or more steps, each step comprising:

a tread/flooring positioned on the stair tread/flooring subfloor and having a groove in its front edge receiving a corresponding tongue of a stair nose molding;

a riser with a top nose portion and a bottom edge portion;

a stair nose molding secured to the top of a step having a perpendicular planar back side and top side to position the stair nose molding to the stair subflooring, a front side, and a bottom side, a cutout in the top side extending to the back side with a vertical front wall and horizontal bottom wall to receive the tread/flooring with the top side of the tread/flooring coplanar with the top side of the stair nose molding, a tongue extending outwardly from the vertical front wall and received and secured in the groove in the front side of the tread flooring, and a groove with parallel walls extending upwardly into the stair nose molding from the bottom side and receiving in a sliding relationship the top edge portion of the riser; and a stair back molding having a perpendicular, planar back side and bottom side to position the molding back side against the stair subfloor and the bottom side against the stair tread/flooring below the step, and a groove with parallel walls extending downwardly into the stair back molding from the top side receiving the bottom edge portion of the stair riser.

2. The stair system according to claim 1 wherein the back side of the stair nose molding is secured to the riser subflooring with an adhesive.

3. The stair system according to claim 1 wherein the stair nose molding is secured to the stair subflooring with one or more screws.

4. The stair system according to claim 1 wherein the stair nose molding is secured to the stair subflooring with one or more nails.

5. The stair system according to claim 1 wherein the stair back molding and the rear edge of the tread/flooring is secured to the stair subflooring by one or more nails extending from the bottom of the channel in the stair back molding, through the stair back molding, and through the back edge portion of the tread/flooring into the subflooring.

6. The stair system according to claim 1 wherein the stair back molding and the rear edge of the tread/flooring is secured to the stair subflooring by one or more screws extending from the bottom of the channel in the stair back molding, through the stair back molding, and through the back edge portion of the tread/flooring into the subflooring.

7. A method of finishing a step of a stair system with one or more steps extending from a lower floor to an upper floor comprising a plurality of parallel stair stringers bridged by stair subflooring comprised of tread subflooring and riser subflooring, the method comprising:

securing a stair back molding to the stair subflooring of a first step and the lower floor, the stair back molding having a top side and perpendicular planar back side and bottom side, positioning the planar back side of the stair back molding against the stair riser subflooring of the first step and the bottom side against the lower floor, the stair back molding having a groove with parallel walls extending downwardly into the stair back molding from the top side;

positioning the bottom edge of a stair riser in the groove of the stair back molding; and forming a combination by joining a stair nose molding and a stair tread and positioning the combination to fit on the tread subflooring of the first step of the stair system, the stair nose molding having a front side, bottom side, perpendicular planar back side, top side, and a planar cutout in the top side extending from the back side toward the front side, the planar cutout having a vertical front wall and horizontal bottom wall, the vertical front wall having a tongue, the front of the stair tread positioned in the planar cutout, and the top side of the stair tread being coplanar with the top side of the stair nose molding, the tongue extending outwardly from the vertical front wall engaged with a groove in the front side of the stair tread, the back edge of the stair tread being spaced apart from the stair riser subflooring of a next step, the stair nose molding having a groove with parallel walls extending upwardly into the stair nose molding from the bottom side, the groove receiving the top edge of the stair riser.

8. The method according to claim 7 wherein the tread on the tread subflooring is secured together with the stair back molding for the second step by positioning the bottom side of the stair back molding against the back edge of the tread and the back side of the stair back molding against the stair subflooring by driving nails from the bottom of the channel in the stair back molding through the stair back molding, and through the back edge of the tread into the stair subflooring.

9. The method according to claim 7 wherein the tread of the first step is secured together with the stair back molding for the second step by positioning the bottom side of the stair back molding against the back edge of the tread and the back side of the stair back molding against the stair subflooring by screwing screws from the bottom of the channel in the stair back molding through the stair back molding, and through the back edge of the tread into the stair subflooring.

10. The method according to claim 9 wherein the stair nose molding is secured to the stair system subflooring by adhesive.

11. The method according to claim 7 wherein the top step is constructed by securing the stair back molding of the top step to the back edge of the penultimate step and the stair subflooring by driving nails through the channel of the stair back molding through the stair back molding and through the back edge of the tread flooring into the stair subflooring; and positioning the bottom edge of the stair riser into the channel of the stair back molding; positioning the stair riser into the channel of the stair nose molding and securing the flooring at the top of the stairs into the cutout of the stair nose molding so that the tongue of the stair nose molding is received by and secured in the groove in the flooring at the top of the stairs, and the back side of the stair nose molding is secured to the stair subflooring.

12. The method according to claim 7 wherein the stair nose molding is secured to the stair system subflooring by adhesive.

13. The method according to claim 7 wherein the method is repeated for each stair of the stair system.

* * * * *